US009240660B1

(12) United States Patent
Arceneaux et al.

(10) Patent No.: US 9,240,660 B1
(45) Date of Patent: Jan. 19, 2016

(54) SLIP RING ASSEMBLY AND METHOD FOR IMPEDANCE MATCHING HIGH FREQUENCY SIGNALS ACROSS THE SLIP RING ASSEMBLY

(71) Applicant: General Electric Company, Schenectady, NY (US)

(72) Inventors: Mario Joseph Arceneaux, Simpsonville, SC (US); Kurt Kramer Schleif, Greenville, SC (US); Donald W. Shaw, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 14/543,944

(22) Filed: Nov. 18, 2014

(51) Int. Cl.
*H01R 39/00* (2006.01)
*H01R 39/08* (2006.01)
*H01R 39/64* (2006.01)

(52) U.S. Cl.
CPC ..... *H01R 39/08* (2013.01); *H01R 39/64* (2013.01)

(58) Field of Classification Search
None
See application file for complete search history.

(56) References Cited

U.S. PATENT DOCUMENTS 5,231,374 A * 7/1993 Larsen ..... H01R 39/64 310/232
8,376,757 B2 * 2/2013 Yamamoto ..... H01R 13/6473 439/18
2004/0161950 A1 8/2004 Coleman

FOREIGN PATENT DOCUMENTS

EP 1748523 11/2009

OTHER PUBLICATIONS

Co-pending U.S. Appl. No. 14/643,242, filed Mar. 10, 2015.
Technical Information, Moog Components Group. pp. 188-192; www.moog.com/components.
Aeroflex Airflyte, Basic Slip Ring Design Guide;www.aeroflex.com/Motion.

* cited by examiner

*Primary Examiner* — Tho D Ta
(74) *Attorney, Agent, or Firm* — Dority & Manning, PA

(57) ABSTRACT

A slip ring assembly includes a pair of conductive rings consecutively positioned along a center shaft of the slip ring assembly. The pair of conductive rings are electronically coupled to a high frequency signal source via a first twisted wire pair. The pair of conductive rings are electronically coupled to a data processor via a second twisted wire pair. The first and second twisted wire pairs have constant target impedances that are substantially similar. The first and second conductive rings are axially spaced at an axial distance that is sized so as to maintain the constant target impedance across the first and second conductive rings during transmission of a high frequency signal from the high frequency signal source to the data processor. The slip ring assembly provides a method for impedance matching across the conductive rings of the slip ring assembly.

19 Claims, 5 Drawing Sheets

SLIP RING ASSEMBLY AND METHOD FOR IMPEDANCE MATCHING HIGH FREQUENCY SIGNALS ACROSS THE SLIP RING ASSEMBLY

FIELD OF THE INVENTION

The present invention generally involves a slip ring coupled to a turbomachine. More specifically, the present invention involves a system and method for impedance matching high-frequency signals across a slip ring.

BACKGROUND OF THE INVENTION

Turbomachines such as wind turbines, gas turbines, steam turbines, pumps, fans, generators, motors, and other forms of commercial equipment frequently include shafts, blades, and other rotating components. It is known in the art to install one or more sensors on the rotating components to measure various characteristics of those components in order to control, monitor, and/or enhance the operation of the rotating components. For example, sensors that measure temperature, velocity, stress, strain, vibrations, and/or other characteristics of the rotating components may allow for early detection of abnormalities, adjustments to repair or maintenance schedules, and/or other actions to enhance operations.

Various contact type slip ring systems are known in the art for transmitting the analogue sensor data from the rotating components to stator components for further analysis and/or for transmitting power to or from a rotatable portion of the slip ring assembly. Conventionally, analogue signals from the sensors are routed via transmission line (i.e. wires) to individual conductive rings of a slip ring assembly. The conductive rings are concentrically positioned along a rotatable center bore or shaft portion of the slip ring assembly. Stationary contact arms or brushes provide a signal path for routing the signals from the conductive rings to a stationary device such as a controller, data processor or the like. The corresponding concentric conductive rings are generally formed with a cross-section shape that may include grooves, slots and/or generally flat or arcuate surfaces that are appropriate for the sliding contact.

In order to accommodate ever increasing data requirements for test and operation of the turbomachine, it is often necessary to transmit high frequency signals such as digitized analogue signals from the sensors to the stationary device via the conductive rings. However, maximum transmission rate across the conductive ring may be limited by various factors.

One potential limiting factor is distortion of the waveforms due to reflections from electrical impedance discontinuities. Impedance discontinuities can occur throughout the slip ring assembly wherever different forms of transmission lines and components interconnect and that have different surge impedances. For example, high-frequency signal losses and/or degradation at the conductive rings may increase with signal frequency due to multiple reflections from impedance mismatches. Some of the highest incidences of impedance mismatches often occur where transmission lines such as a twisted wire pair from the sensors connect at a conductive ring and/or at the brush-conductive ring interface of a slip ring assembly and/or at connector interfaces.

Typically, impedance mismatches may be mitigated by increasing or decreasing the contact surface area (i.e. the width) of the conductive rings that carry high-frequency signals. However, due to limited axial space provided along a center bore of shaft portion of a slip ring assembly, this methodology may limit the number of conductive rings allowed along a given axial length of the center shaft. As a result the number of sensors that may be utilized, particularly in cases where overall axial length of the slip ring assembly is at issue, may be limited. Therefore, a system and method for impedance matching high frequency signals across a slip ring assembly that optimizes axial spacing along a center bore or shaft of a slip ring assembly would be useful.

BRIEF DESCRIPTION OF THE INVENTION

Aspects and advantages of the invention are set forth below in the following description, or may be obvious from the description, or may be learned through practice of the invention.

One embodiment of the present invention is a slip ring assembly. The slip ring assembly includes a pair of conductive rings consecutively positioned along a center shaft of the slip ring assembly. A first conductive ring of the pair is electronically coupled to a high frequency signal source via a first wire of a first twisted wire pair. A second conductive ring of the pair is electronically coupled to the high frequency signal source via a second wire of the first twisted wire pair. The first twisted wire pair has a constant target impedance. The slip ring assembly further comprises a second twisted wire pair. The second twisted wire pair includes a first wire that electronically couples a contact member that is in contact with the first conductive ring to a data processor. A second wire of the second twisted wire pair electronically couples another contact member that is in contact with the second conductive ring to the data processor. The second twisted wire pair has constant target impedance that is substantially the same as the first twisted wire pair. The first and second conductive rings are axially spaced at an axial distance that is sized so as to maintain the constant target impedance across the first and second conductive rings when a high frequency signal is transmitted from the high frequency signal source to the data processor.

Another embodiment of the present invention is a slip ring assembly. The slip ring assembly includes a first set of conductive rings concentrically aligned along a center shaft of the slip ring assembly. The first set of conductive rings includes a first conductive ring that is electronically coupled to a high frequency signal source via a first wire of a first twisted wire pair having a constant target impedance. The first set further includes a second conductive ring that is electronically coupled to a low frequency signal or a power source. The first and second conductive rings are axially separated a first axial distance. The slip ring assembly further includes a second set of conductive rings concentrically aligned along the center shaft. The second set of conductive rings include a first conductive ring electronically coupled to the high frequency signal source via a second wire of the first twisted wire pair. The second set further includes a second conductive ring electronically coupled to a low frequency signal or a power source. The first and second conductive rings are axially separated a second axial distance. A first wire of a second twisted wire pair electronically couples a contact member that is in contact with the first conductive ring of the first set of conductive rings to a data processor. A second wire of the second twisted wire pair electronically couples another contact member that is in contact with the first conductive ring of the second set of conductive rings to the data processor. The second twisted wire pair has a constant target impedance that is substantially the same as the first twisted wire pair. The first conductive rings of the first and second sets of conductive rings are axially separated a third axial distance that is greater than the first or second axial distances. The third axial distance is sized so as to maintain the constant target impedance across the first and second conductive rings during transmission of a high frequency signal from the high frequency signal source to the data processor.

One embodiment of the present invention is a method for impedance matching high frequency signals across conductive rings of a slip ring assembly. The method includes selecting a first twisted wire pair and a second twisted wire pair each having a substantially similar target constant impedance. The first twisted wire pair electronically couples a high frequency signal source to a first conductive ring of a first set of conductive rings and to a first conductive ring of a second set of conductive rings. The second twisted wire pair electronically couples the first conductive rings of both the first and second sets of conductive rings to a data processor. The method also includes axially spacing the first conductive rings of the first and second sets of conductive rings via an electrical insulating material an axial distance. The axial distance is sized so as to substantially match the impedance of the high frequency signal from the high frequency signal source through the first twisted wire pair, across the first conductive rings and through the second twisted wire pair. The method further includes transmitting the high frequency signal from the high frequency signal source, through the first twisted wire pair, across the first conductive rings and to the second twisted wire pair.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in that.

DETAILED DESCRIPTION OF THE INVENTION

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Although exemplary embodiments of the present invention will be described generally in the context of a gas turbine for purposes of illustration, one of ordinary skill in the art will readily appreciate that embodiments of the present invention may be applied to any turbomachine such as a steam turbine, a wind turbine, a fan or the like that includes a slip ring assembly for transmitting data, control or other signals or power from or to various electronics and/or sensors coupled to a rotating shaft. The specification is not intended to be limited to a gas turbine turbomachine unless otherwise specified in the claims.

Figure 1:
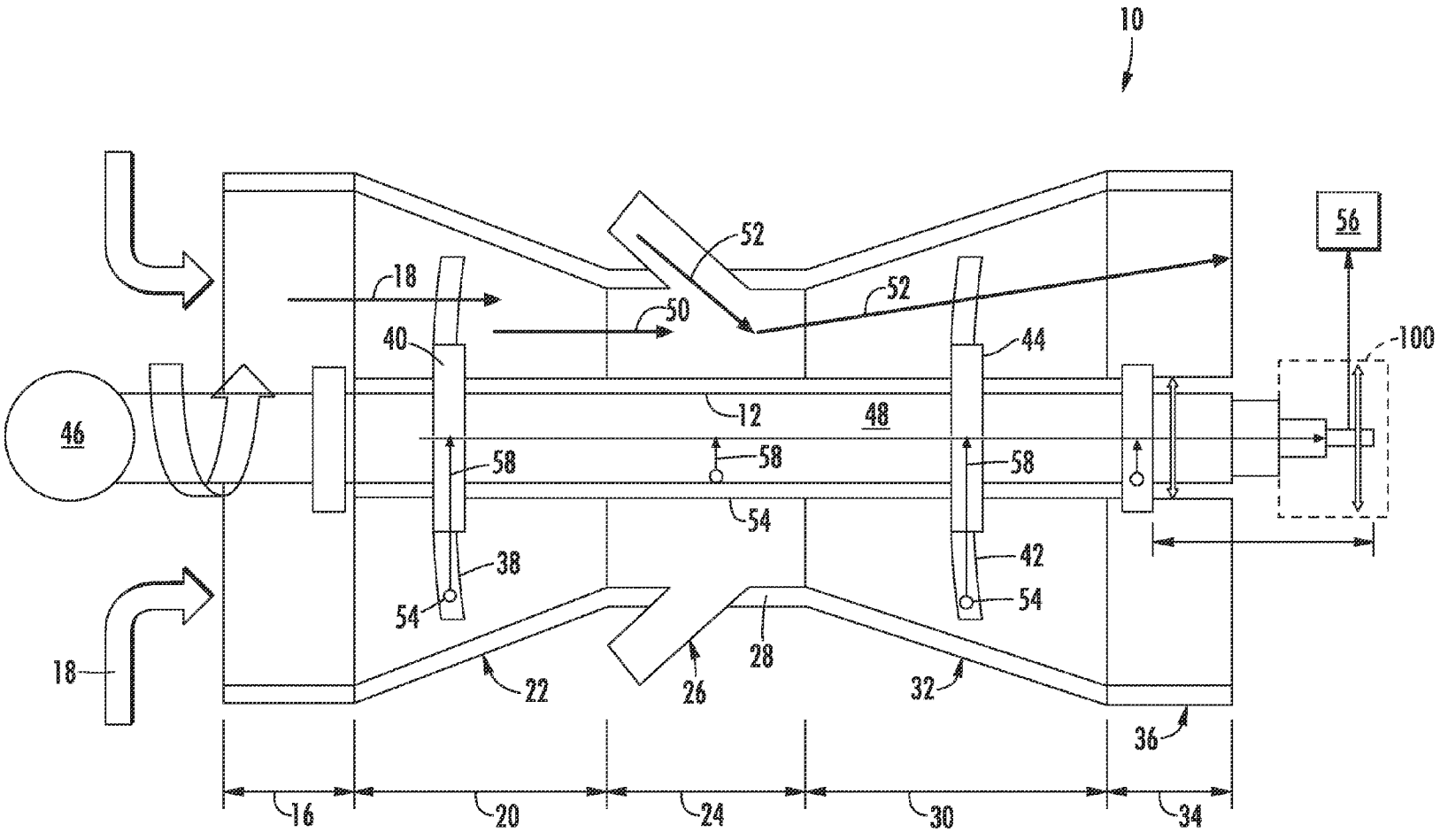
FIG. 1 is a functional block diagram of an exemplary turbomachine having a rotor shaft that extends along an axial centerline of the turbomachine as may be incorporated into various embodiments of the present invention.

Referring now to the drawings, wherein identical numerals indicate the same elements throughout the figures, FIG. 1 provides a functional block diagram of an exemplary turbomachine 10 having a rotor shaft 12 that extends along an axial centerline of the turbomachine 10. In particular embodiments, as shown in FIG. 1 the turbomachine 10 is a gas turbine 14. The gas turbine 14 generally includes an inlet section 16 that may include a series of filters, cooling coils, moisture separators, and/or other devices (not shown) to purify and otherwise condition air 18 entering the gas turbine 14. A compressor section 20 including a compressor 22 is disposed downstream from the inlet section 16. A combustion section 24 is disposed downstream from the compressor section 20 and may include a plurality of combustors 26 annularly arranged around an outer casing 28 such as a compressor discharge casing.

A turbine section 30 including a high and/or low pressure turbine 32 is disposed downstream from the combustion section 24. The gas turbine 14 may also include an exhaust section 34 that includes an exhaust duct or diffuser 36 that is disposed downstream from an outlet of the turbine 32. In particular embodiments, the inlet section 16, compressor 22, the combustion section 24, turbine 32 and the exhaust duct 36 define a primary flow passage through the gas turbine 12.

The compressor 20 generally includes multiple rows or stages of compressor blades 38 (only one stage shown) where each row of compressor blades 38 is coupled to the rotor shaft 12 via a compressor rotor disk 40. In addition, the turbine 32 generally includes multiple rows or stages of turbine blades 42 (only one stage shown) where each row of the turbine blades 42 may be coupled to the rotor shaft 12 via a turbine rotor disk 44. The compressor and turbine blades 38, 42 are generally mounted, angled and/or formed such that rotation of the rotor shaft 12 causes the air 18 to be drawn through the inlet section 16 and into the compressor 22.

In particular embodiments, the rotor shaft 12 may be connected to a motor and/or a generator 46 in order to turn the rotor shaft 12 and/or to generate electrical power and/or mechanical work. The rotor shaft 12 may be a single shaft or may include multiple shafts coupled together to form a singular shaft through the turbomachine 10 or gas turbine 14. In particular embodiments, the rotor shaft 12 is annularly shaped to form or define an inner passage 48 that extends axially therethrough.

In operation, air 18 is drawn through the inlet section 16 and into the compressor 22 where it is progressively compressed so as to provide compressed air 50 to the combustion section 24. The compressed air 50 is routed to the combustors 26 where it is mixed with a fuel. The fuel-air mixture in each combustor 26 is burned, thus generating high temperature combustion gases 52 at a high velocity. The combustion gases 52 are routed through the turbine 32 where thermal and kinetic energy are transferred from the combustion gases 52 to the turbine blades 42, thus causing the rotor shaft 12 to rotate. The combustion gases 52 are exhausted through the exhaust duct 36.

During operation of a turbomachine 10 such as the gas turbine 14 described herein, the various rotatable components such as the compressor blades 38, the compressor rotor disks 40, the turbine blades 42, the turbine rotor disks 44, the rotor shaft 12 and various other rotatable turbomachine components are exposed to potentially life limiting thermal and/or mechanical stresses. As a result, it is generally desirable to monitor various operating parameters such as temperature, velocity, stress, strain, vibrations, and/or other characteristics of the rotating components that may allow for early detection of abnormalities, allow for adjustments to repair or maintenance schedules, and/or other actions to enhance operation and/or efficiency of the turbomachine 10.

In order to monitor the various operating parameters at the various rotatable components, sensors 54 may be coupled to or disposed proximate to the various rotatable components within the turbomachine 10. The sensors 54 may comprise pressure detectors, strain gauges, or accelerometers that generate one or more signals reflective of vibrations or movement by the compressor blades 38, turbine blades 42, or other rotating components. In other embodiments, the sensors 54 may comprise thermocouples or resistance temperature detectors that generate one or more signals reflective of the temperature of the various rotating components. One of ordinary skill in the art will readily appreciate that embodiments of the present invention are not limited to any particular sensor unless specifically recited in the claims.

The sensors 54 may be placed on the compressor blades 38, compressor rotor disks 40, turbine blades 42, and turbine rotor disks 44, within the inner passage 48 of the rotor shaft 12 or on any rotatable component of the turbomachine. Signals are transmitted from the rotatable sensors 54 to a stationary data processor 56 such as a controller or computing device via the wires 58 and a slip ring assembly. In particular embodiments, at least some of the sensors 54 are electronically coupled via wires 58 to various electronics that convert the otherwise analogue signals to digitized signals at relatively high frequencies upstream from the slip ring assembly.

Figure 2:
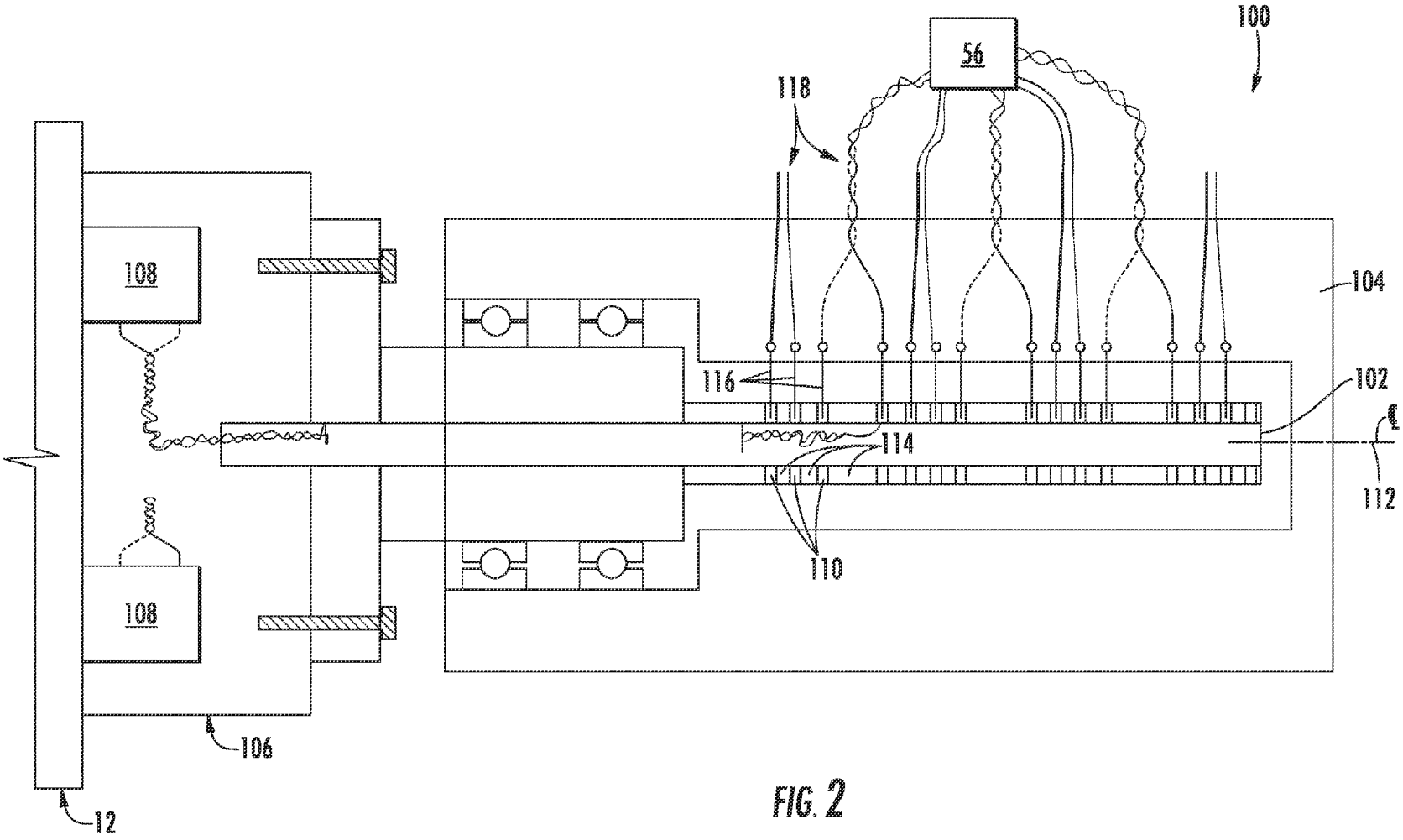
FIG. 2 is a partial cut away side view of a portion of an exemplary slip ring assembly as may incorporate one or more embodiments of the present invention.

FIG. 2 provides a partial cut away side view of a portion of an exemplary slip ring assembly 100 as may incorporate one or more embodiments of the present invention. In particular embodiments, as shown in FIG. 2, the slip ring assembly 100 generally includes a rotatable center shaft 102 that is circumferentially surrounded by a stator or stationary portion 104. The center shaft 102 is coupled at one end to the rotor shaft 12 of the gas turbine 10. In particular embodiments, the center shaft 102 is coupled to the rotor shaft 12 via a rotatable carrier shaft 106 that is concentrically aligned with the center shaft 102 and the rotor shaft 12.

In various embodiments, at least one analog to digital convertor 108 is disposed within the carrier shaft 106. Certain sensors 54 (FIG. 1) such as thermocouples are coupled to the analog to digital convertor 108 via wires 58. The analog to digital convertor 108 digitizes the analog signals from the sensors 54 into digitized high frequency signals.

In various embodiments, as shown in FIG. 2, a plurality of conductive rings 110 are concentrically aligned and axially spaced along the center shaft 102 with respect to an axial centerline 112 thereof. At least some of the conductive rings 110 are used to transfer analog and digital signals from the sensors 54 through the slip ring assembly 100 and on to the data processor 56. At least some of the conductive rings 110 may be used to transfer power to the analog to digital convertors 108 or other devices downstream from the center shaft 102. Each conductive ring 110 is axially separated from adjacent conductive rings 110 by an electrically insulating material 114.

In various embodiments, the slip ring assembly 100 further comprises multiple brushes or contact members 116 that are fixedly connected to the stator portion 104. Each contact member 116 is aligned with a corresponding conductive ring 110 and is configured to slideably engage with the corresponding conductive ring 110, thus defining a signal or current path between the two components. In various embodiments, the contact members 116 are electronically coupled to the data processor 56 and/or a power supply (not shown) via wires 118. As previously stated herein, impedance matching of the signals between the sensors 54 and the data processor 56, particularly with regards to digitized signals provided by the analog to digital converter 108, is critical for reducing signal noise and/or corruption that may result from high-speed signal reflections from impedance discontinuities/mismatches along the signal path defined therebetween.

Figure 3:
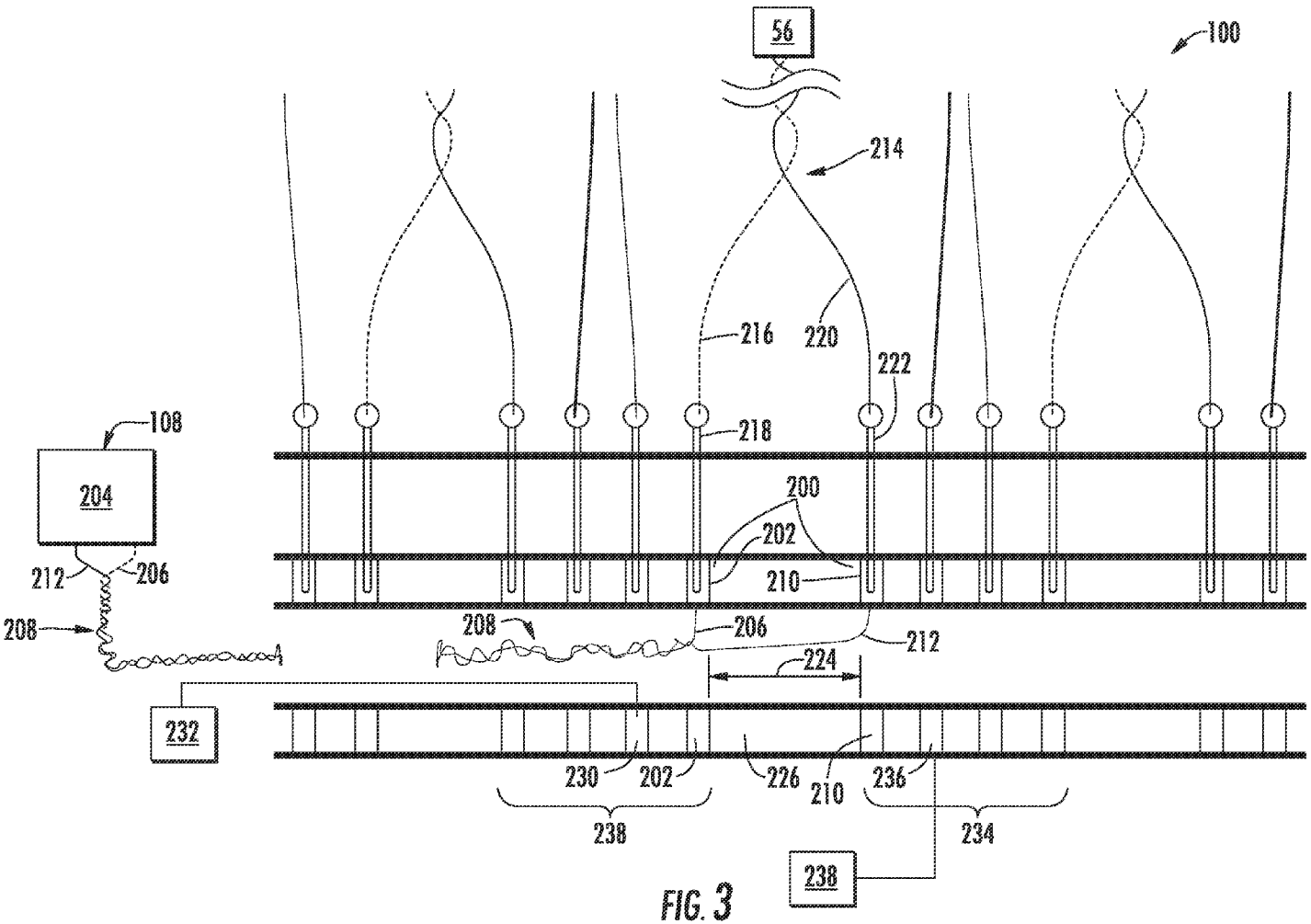
FIG. 3 is an enlarged view of a portion of the slip ring assembly as shown in FIG. 2, according to at least one embodiment of the present invention.

FIG. 3 provides an enlarged view of a portion of the slip ring assembly 100 according to at least one embodiment of the present invention that reduces and/or prevents impedance discontinuities and/or mismatches of digitized and/or high frequency signals transmitted to the data processor 56 (FIGS. 1 and 2). In one embodiment, as shown in FIG. 3, the slip ring assembly 100 includes a pair of conductive rings 200 consecutively positioned along the center shaft 102. A first conductive ring 202 of the pair of conductive rings 200 is electronically coupled to a high frequency signal source 204 such as the analog to digital convertor 108 via a first wire 206 of a first twisted wire pair 208. A second conductive ring 210 of the pair of conductive rings 200 is electronically coupled to the high frequency signal source 204 via a second wire 212 of the first twisted wire pair 208. The first twisted wire pair 208 has a constant target impedance.

The slip ring assembly 100 further comprises a second twisted wire pair 214. The second twisted wire pair 214 includes a first wire 216 that electronically couples a contact member 218 that is in contact with the first conductive ring 202 to the data processor 56. A second wire 220 of the second twisted wire pair 214 electronically couples another contact member 222 that is in contact with the second conductive ring 210 to the data processor 56. The second twisted wire pair 214 has constant target impedance that is substantially the same as the first twisted wire pair 208.

The first and second conductive rings 202, 210 are axially spaced at an axial distance 224 that is sized so as to maintain the constant target impedance of the first and second twisted wire pairs 208, 214 across the first and second conductive rings 202, 210 when a high frequency signal is transmitted from the high frequency signal source 204 to the data processor 54 via the first twisted wire pair 208, across the conductive rings 202, 210 and the second twisted wire pair 214. The axial distance may be measured from outer edges, inner edges or a center of each of the first and second conductive rings 202, 210.

In particular embodiments, the constant target impedance of the first and second twisted wire pairs 208, 214 may be from approximately 50 to 150 ohms. In certain embodiments, the constant target impedance of the first and second twisted wire pairs 208, 214 is about 100 ohms. In particular embodiments, the first and second conductive rings 202, 210 of the pair of conductive rings 200 are axially separated by an electrically insulating material 226.

In particular embodiments, as shown in FIG. 3, the first conductive ring 202 of the pair of conductive rings 200 is part of a first set of conductive rings 228. The first set of conductive rings 228 comprises at least one additional conductive ring 230 disposed adjacent to the first conductive ring 202 and that is electronically coupled to a secondary signal or power source 232. In particular embodiments, the additional conductive ring 230 may be electronically coupled to one of the sensors 54 or other analog or low frequency signal source, to a power source and/or to ground.

In particular embodiments, as shown in FIG. 3, the second conductive ring 210 of the pair of conductive rings 200 is part of a second set of conductive rings 234, the second set of conductive rings 234 includes at least one additional conductive ring 236 disposed adjacent to the second conductive ring 210 of the pair of conductive rings 200. The additional conductive ring 236 is electronically coupled to a secondary signal or power source 238. In particular embodiments, the additional conductive ring 236 may be electronically coupled to one of the sensors 54 or other analog or low frequency signal source, to a power source and/or to ground.

Figure 4:
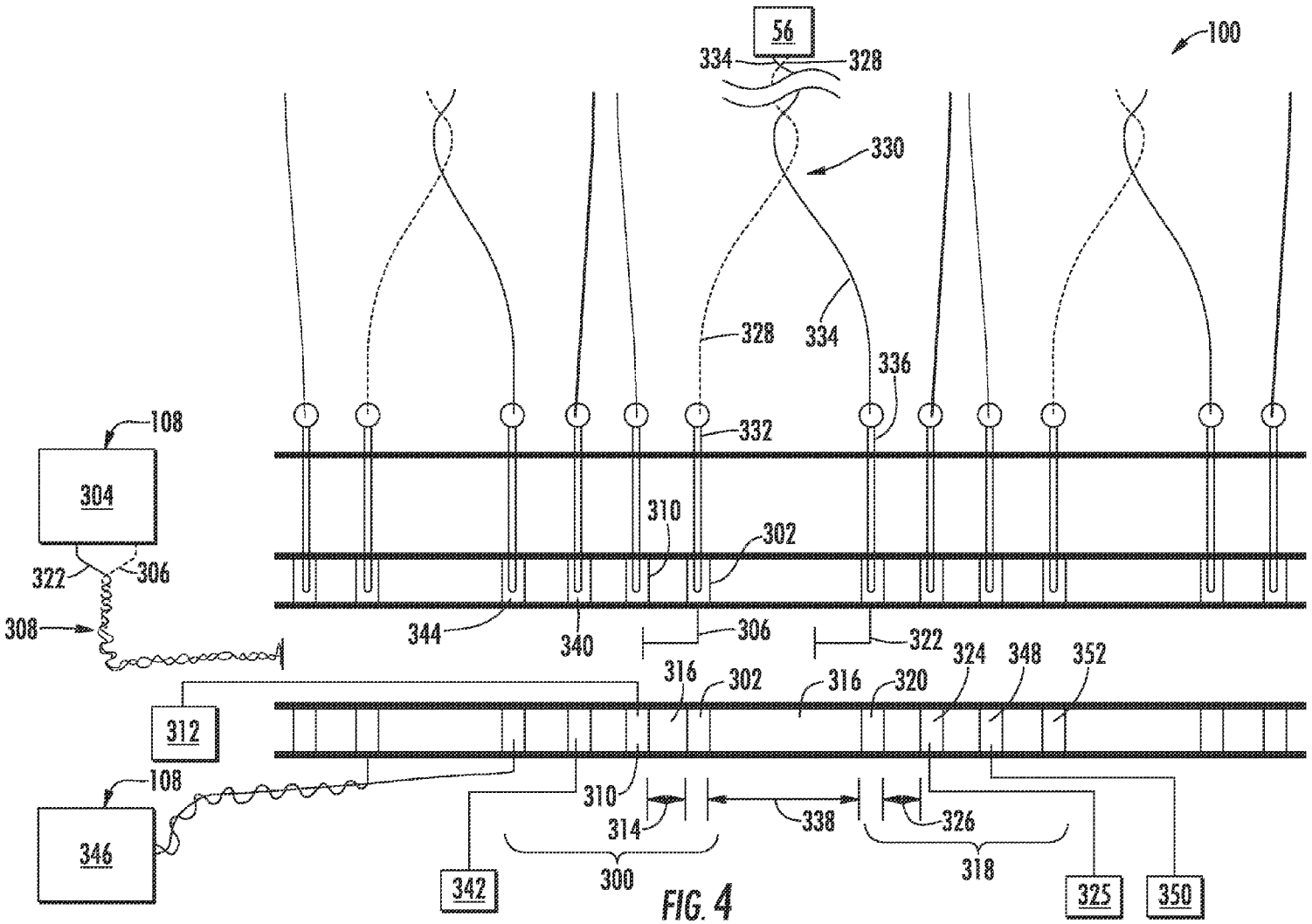
FIG. 4 is an enlarged view of a portion of the slip ring assembly as shown in FIG. 2, according to at least one embodiment of the present invention.

FIG. 4 provides an enlarged view of a portion of the slip ring assembly 100 according to at least one embodiment of the present invention that reduces and/or prevents impedance discontinuities and/or mismatches of digitized and/or high frequency signals transmitted to the data processor 56 (FIGS. 1 and 2). In one embodiment, as shown in FIG. 4, the slip ring assembly 100 includes a first set of conductive rings 300 concentrically aligned along the center shaft 102. The first set of conductive rings 300 includes a first conductive ring 302 that is electronically coupled to a high frequency signal source 304 such as one of the analog to digital convertors 108 via a first wire 306 of a first twisted wire pair 308 having a constant target impedance. The first set of conductive rings 300 further includes a second conductive ring 310 that is electronically coupled to a low frequency signal or a power source 312 such as one of the sensors 54 or other analog or low frequency signal source or to ground. The first and second conductive rings 302, 310 of the first set of conductive rings 300 are axially separated a first axial distance 314. In particular embodiments, the first and second conductive rings 302, 310 of the first set of conductive rings 300 are axially separated via an electrically insulating material 316 disposed along the center shaft 102.

The slip ring assembly 100 further includes a second set of conductive rings 318 that are concentrically aligned along the center shaft 102. The second set of conductive rings 318 includes a first conductive ring 320 that is electronically coupled to the high frequency signal source 304 via a second wire 322 of the first twisted wire pair 308. The second set of conductive rings 318 further includes a second conductive ring 324 that is electronically coupled to a low frequency signal or a power source 325 such as one of the sensors 54 or other analog or low frequency signal source or to ground. The first and second conductive rings 320, 324 of the second set of conductive rings 318 are axially separated a second axial distance 326.

A first wire 328 of a second twisted wire pair 330 electronically couples a contact member 332 that is in contact with the first conductive ring 302 of the first set of conductive rings 300 to the data processor 56. A second wire 334 of the second twisted wire pair 330 electronically couples another contact member 336 that is in contact with the first conductive ring 320 of the second set of conductive rings 318 to the data processor 56. The second twisted wire pair 330 has a constant target impedance that is substantially the same as the constant target impedance of the first twisted wire pair 308.

The first conductive rings 302, 320 of the first and second sets of conductive rings 300, 318 are axially separated a third axial distance 338 that is greater than the first or second axial distances 314, 326. The third axial distance 338 is sized so as to maintain the constant target impedance across the first conductive rings 302, 320 of the first and second sets of conductive rings 300, 318 during transmission of a high frequency signal from the high frequency signal source 304 to the data processor 56.

In particular embodiments, the first conductive rings 302, 320 of the first and second conductive ring sets 300, 318 are axially separated by the electrically insulating material 316. In one embodiment, the first and second conductive rings 302, 31 and 320, 324 of the first and second conductive ring sets 300, 318 are axially separated by the electrically insulating material 316. In one embodiment, the first set of conductive rings 300 further comprises a third conductive ring 340 disposed adjacent to the second conductive ring 310, wherein the third conductive 340 ring may be electronically coupled to a low frequency signal or a power source 342 such as one of the sensors 54 or other analog or low frequency signal source or to ground to one of a low frequency signal or power source. In one embodiment, the first set of conductive rings 318 further comprises a fourth conductive 344 ring disposed adjacent to the third conductive ring 340. The fourth conductive ring 344 may be electronically coupled to a high frequency signal source 346 such as one of the analog to digital convertors 108.

In one embodiment, the second set of conductive rings 318 further comprises a third conductive ring 348 disposed adjacent to the second conductive ring 324. The third conductive ring 348 may be electronically coupled to a low frequency signal or a power source 350 such as one of the sensors 54 or other analog or low frequency signal source or to ground. In particular embodiments, the second set of conductive rings 318 further comprises a fourth conductive ring 352 disposed adjacent to the third conductive ring 348. The fourth conductive ring 352 may be electronically coupled to a high frequency signal source 354 such as one of the analog to digital convertors 108.

Figure 5:
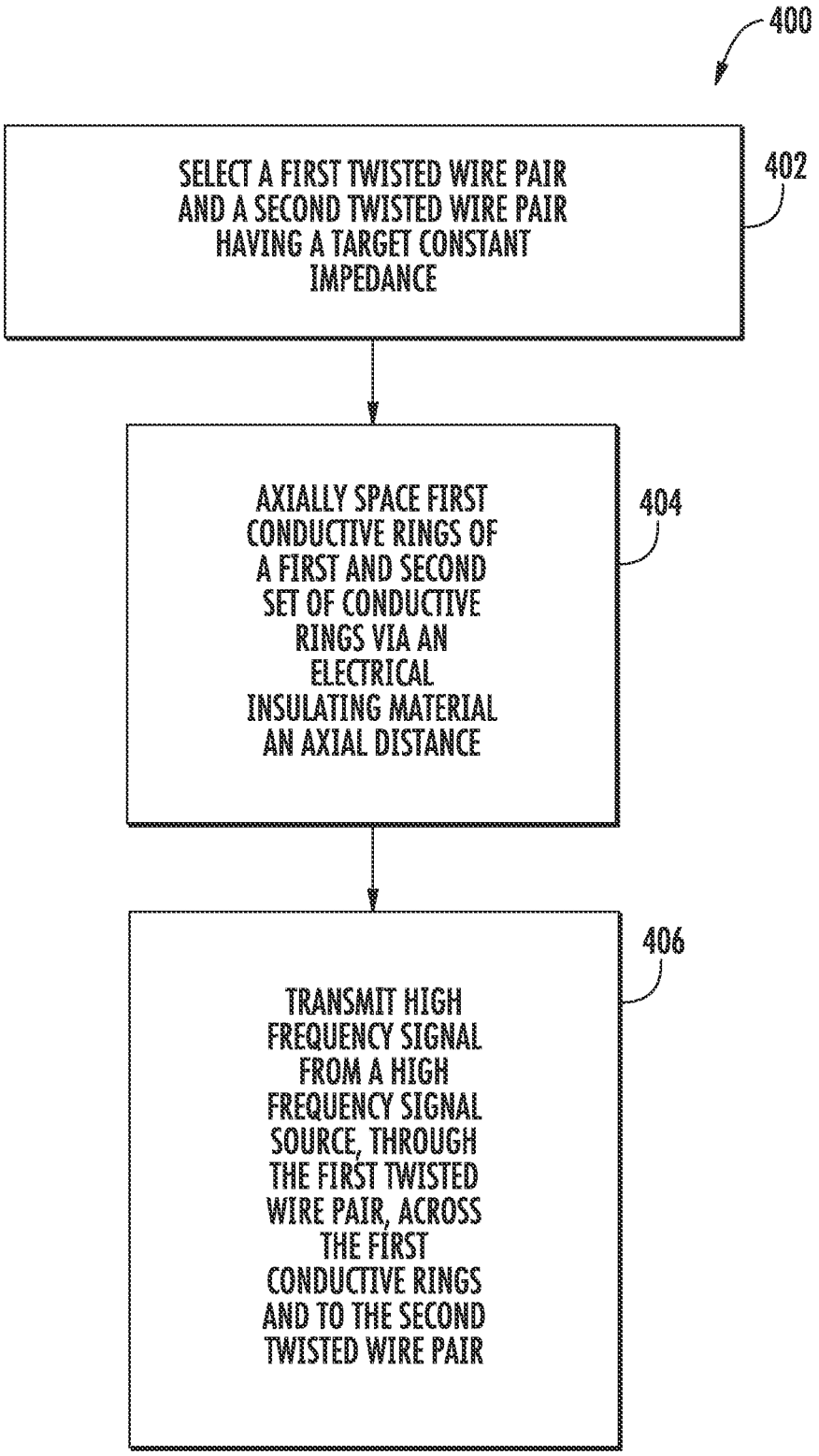
FIG. 5 is a block diagram of an exemplary method for impedance matching high frequency signals across conductive rings of a slip ring assembly.

The various embodiments of the slip ring assembly 100 as illustrated in FIGS. 2 thru 4 and as described herein provide for a method for impedance matching high frequency signals across conductive rings of a slip ring assembly, herein referred to as "method". FIG. 5 is a block diagram of an exemplary method 400 for impedance matching high frequency signals across conductive rings of a slip ring assembly. At 402, method 400 includes selecting a first twisted wire pair 208, 308 and a second twisted wire pair 214, 330 each having a substantially similar constant target impedance. The first twisted wire pair 214, 330 electronically couples a high frequency signal source 204, 304 to a first conductive ring 202, 302 of a first set of conductive rings 228, 300 and to a first conductive ring 210, 320 of a second set of conductive rings 234, 318. The second twisted wire pair 214, 330 electronically couples the first conductive rings 202, 302 of both the first and second sets of conductive rings 228, 300 to the data processor 56.

At 404, method 400 includes axially spacing the first conductive rings 202, 302 of the first and second sets of conductive rings 228, 234 and 300, 318 via an electrical insulating material 226, 316 an axial distance 224, 338. The axial distance is sized so as to substantially match the impedance of the high frequency signal from the high frequency signal source 204, 304 through the first twisted wire pair 208, 308, across the first conductive rings 202, 210 and 302, 320 and through the second twisted wire pair 214, 330. At 406, method 400 further includes transmitting the high frequency signal from the high frequency signal source 204, 304, through the first twisted wire pair 208, 308, across the first conductive rings 202, 210 and 302, 320 and to the second twisted wire pair 214, 330 and on to the data processor 56.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A slip ring assembly, comprising:

a pair of conductive rings consecutively positioned along a center shaft of the slip ring assembly, a first conductive ring of the pair being electronically coupled to a high frequency signal source via a first wire of a first twisted wire pair and a second conductive ring of the pair being electronically coupled to the high frequency signal source via a second wire of the first twisted wire pair, wherein the first twisted wire pair has a constant target impedance; and a second twisted wire pair including a first wire electronically coupling a contact member in contact with the first conductive ring to a data processor and a second wire of the second twisted wire pair electronically coupling another contact member in contact with the second conductive ring to the data processor, wherein the second twisted wire pair has a constant target impedance that is substantially the same as the first twisted wire pair;

wherein the first and second conductive rings are axially spaced at an axial distance that is sized so as to maintain the constant target impedance across the first and second conductive rings during transmission of a high frequency signal from the high frequency signal source to the data processor.

2. The slip ring assembly as in claim 1, wherein the first and second conductive rings are axially separated by an electrically insulating material.

3. The slip ring assembly as in claim 1, wherein the first conductive ring of the pair of conductive rings is part of a first set of conductive rings, the first set comprising at least one conductive ring disposed adjacent to the first conductive ring, wherein the conductive ring is electronically coupled to one of a low frequency signal source, ground or a power source.

4. The slip ring assembly as in claim 1, wherein the second conductive ring of the pair of conductive rings is part of a second set of conductive rings, the second set comprising at least one conductive ring disposed adjacent to the second conductive ring, wherein the conductive ring is electronically coupled to one of a low frequency signal source, ground or a power source.

5. The slip ring assembly as in claim 1, wherein the high frequency signal source is electronically coupled to a sensor, wherein the sensor is connected to a rotatable component of a turbomachine.

6. The slip ring assembly as in claim 5, wherein the turbomachine is a gas turbine.

7. A slip ring assembly, comprising:

a first set of conductive rings concentrically aligned along a center shaft of the slip ring assembly, the first set of conductive rings including a first conductive ring electronically coupled to a high frequency signal source via a first wire of a first twisted wire pair having a constant target impedance, the first set further including a second conductive ring electronically coupled to a low frequency signal or a power source, wherein the first and second conductive rings are axially separated a first axial distance;

a second set of conductive rings concentrically aligned along the center shaft, the second set of conductive rings including a first conductive ring electronically coupled to the high frequency signal source via a second wire of the first twisted wire pair, the second set further including a second conductive ring electronically coupled to a low frequency signal or a power source, wherein the first and second conductive rings are axially separated a second axial distance; and a second twisted wire pair including a first wire electronically coupling a contact member in contact with the first conductive ring of the first set of conductive rings to a data processor and a second wire of the second twisted wire pair electronically coupling another contact member in contact with the first conductive ring of the second set of conductive rings to the data processor, wherein the second twisted wire pair has a constant target impedance that is substantially the same as the first twisted wire pair;

wherein the first conductive rings of the first and second sets of conductive rings are axially separated a third axial distance, wherein the third axial distance is greater than the first or second axial distances, the third axial distance sized so as to maintain constant target impedance across the first and second conductive rings during transmission of a high frequency signal from the high frequency signal source to the data processor.

8. The slip ring assembly as in claim 7, wherein the first conductive rings of the first and second conductive ring sets are axially separated by an electrically insulating material.

9. The slip ring assembly as in claim 7, wherein the first and second conductive rings of both the first and second conductive ring sets are axially separated by an electrically insulating material.

10. The slip ring assembly as in claim 7, wherein the first set of conductive rings further comprises a third conductive ring disposed adjacent to the second conductive ring, wherein the third conductive ring is electronically coupled to one of a low frequency signal or power source.

11. The slip ring assembly as in claim 10, wherein the first set of conductive rings further comprises a fourth conductive ring disposed adjacent to the third conductive ring, wherein the fourth conductive ring is electronically coupled to a high frequency signal source.

12. The slip ring assembly as in claim 7, wherein the second set of conductive rings further comprises a third conductive ring disposed adjacent to the second conductive ring, wherein the third conductive ring is electronically coupled to one of a low frequency signal or power source.

13. The slip ring assembly as in claim 12, wherein the second set of conductive rings further comprises a fourth conductive ring disposed adjacent to the third conductive ring, wherein the fourth conductive ring is electronically coupled to a high frequency signal source.

14. The slip ring assembly as in claim 7, wherein the high frequency signal source is electronically coupled to a sensor, wherein the sensor is connected to a rotatable component of a turbomachine.

15. The slip ring assembly as in claim 14, wherein the turbomachine is a gas turbine.

16. A method for impedance matching high frequency signals across conductive rings of a slip ring assembly, comprising:

selecting a first twisted wire pair and a second twisted wire pair having a target constant impedance, wherein the first twisted wire pair electronically couples a high frequency signal source to a first conductive ring of a first set of conductive rings and to a first conductive ring of a second set of conductive rings, and wherein the second twisted wire pair electronically couples the first conductive rings of both the first and second sets of conductive rings to a data processor;

axially spacing the first conductive rings of the first and second sets of conductive rings via an electrical insulating material an axial distance, the axial distance sized so as to substantially match the impedance of the high frequency signal from the high frequency signal source through the first twisted wire pair, across the first conductive rings and through the second twisted wire pair; and transmitting the high frequency signal from the high frequency signal source, through the first twisted wire pair, across the first conductive rings and to the second twisted wire pair.

17. The method as in claim 16, wherein the target impedance is between 50 and 150 ohms.

18. The method as in claim 17, wherein the first conductive ring set further comprises a second conductive ring adjacent to the first conductive ring, the method further comprising sending one of a low frequency signal or power across the second conductive ring.

19. The method as in claim 17, wherein the second conductive ring set further comprises a second conductive ring adjacent to the first conductive ring, the method further comprising sending one of a low frequency signal or power across the second conductive ring.

* * * * *